US005848749A

United States Patent [19]

Ljungström

[11] Patent Number: 5,848,749

[45] **Date of Patent: *Dec. 15, 1998**

[54] GABLE TOP CARTON AND CARTON BLANK WITH CURVED SIDE CREASES AND COINCIDENT CORNER CREASES

[75] Inventor: Tommy Bo Göran Ljungström, Hoor, Sweden

[73] Assignee: Tetra Laval Holdings & Finance, SA, Pully, Switzerland

[ * ] Notice: The term of this patent shall not extend beyond the expiration date of Pat. No. 5,474,232.

[21] Appl. No.: 795,378

[22] Filed: Feb. 4, 1997

Related U.S. Application Data

[63] Continuation-in-part of Ser. No. 562,317, Nov. 22, 1995, Pat. No. 5,725,147, which is a continuation of Ser. No. 238,923, May 6, 1994, Pat. No. 5,474,232.

[51] Int. Cl.[6] ..... B65D 5/08

[52] U.S. Cl. ..... 229/137; 229/930; 229/213

[58] Field of Search ..... 229/137, 138, 229/125.42, 213, 214, 930, 183

[56] References Cited

U.S. PATENT DOCUMENTS

| | | | |
|---|---|---|---|
| 3,294,310 | 12/1966 | Miller et al. | 229/137 |
| 3,537,634 | 11/1970 | Collie . | |
| 4,184,624 | 1/1980 | MaGill . | |
| 4,206,867 | 6/1980 | Skjelby . | |
| 4,394,954 | 7/1983 | Lisiecki . | |
| 4,559,259 | 12/1985 | Cetrelli . | |
| 4,586,650 | 5/1986 | Sasaki et al. . | |
| 4,909,432 | 3/1990 | Nagata . | |
| 5,337,538 | 8/1994 | Ljungstrom | 229/138 X |
| 5,474,232 | 12/1995 | Ljungstrom et al. | 229/137 |
| 5,725,147 | 3/1998 | Ljungstrom et al. | 229/137 |

*Primary Examiner*—Gary E. Elkins
*Assistant Examiner*—Tri M. Mai
*Attorney, Agent, or Firm*—Michael A. Catania

[57] ABSTRACT

A gable top carton and its corresponding carton blank are disclosed. The carton includes curved side creases that are defined by curved score lines that divide one or more side panels from a top gabled structure and/or a bottom structure. The gabled structure includes pairs of diagonal creases defined by diagonal score lines. The diagonal score lines form an apex at one end and extend to vertical score lines that separate the side panels of the carton at the edge between adjacent side panels. The diagonal score lines form an angle with the vertical score lines. The vertex of the angle formed is coincident with the vertical score line to facilitate folding and create better quality corners by reducing bunching of carton material at the corner.

4 Claims, 11 Drawing Sheets

GABLE TOP CARTON AND CARTON BLANK WITH CURVED SIDE CREASES AND COINCIDENT CORNER CREASES

CROSS-REFERENCE TO RELATED APPLICATIONS

This application is a continuation-in-part of patent application U.S. Ser. No. 08/562,317 filed Nov. 22, 1995, now U.S. pat. No. 5,725,147, which is a continuation of U.S. Ser. No. 08/238,923, filed May 6, 1994, now U.S. Pat. No. 5,474,232.

STATEMENT REGARDING FEDERALLY SPONSORED RESEARCH OR DEVELOPMENT

Not Applicable

BACKGROUND OF THE INVENTION

The present invention is directed to a packaging container and its corresponding blank configuration. More particularly, the present invention is directed to a gable top carton including one or more curved side creases that are each defined by one or more curved score lines and pairs of diagonal creases that are each defined by diagonal score lines. The diagonal score lines extend to respective vertical score lines thereby forming a vertex of an angle that is coincident with the vertical score lines at the edges of the carton to facilitate folding of the gabled portion of the carton.

Gable top cartons have been known for the better part of the twentieth century. Their characteristic simplicity and resealability have helped to sustain their popularity as containers for traditional liquid food products such as milk and juice, but in recent years they have been used for products ranging from ammunition to Epsom salts. Gable top cartons typically start out as generally rectangular carton blanks made of laminated paperboard or similar material. The carton blanks are provided with a number of creases to facilitate folding and forming the blank into a carton.

When fully folded, filled, and sealed, most gable top cartons include a gabled top structure that engages a plurality of side panels. These side panels form a hollow rectangular body. At the end of this hollow rectangular body opposite the gabled top structure, there is a bottom structure.

The bottom structures of the prior art may be formed in accordance with several different constructions. A first construction is shown in U.S. Pat. No. 3,164,315, issued on Jan. 5, 1965 to N. A. Kelly. As illustrated in that patent, the bottom is formed primarily by four bottom panels that engage the side panels at respective straight score lines that each define a straight crease. Two bottom panels each include two converging score lines. The other two bottom panels do not include further score lines. One of the two non-scored bottom panels is longer than the other. When folded, a portion of the longer, non-scored bottom panel overlaps a portion of the opposite non-scored bottom panel to assist in scaling the bottom structure.

Although the bottom structure of the carton disclosed in the '315 patent provides generally adequate sealing, there is room for improvement. For example, the portion of the longer, non-scored bottom panel that overlaps the opposite non-scored bottom panel forms a ridge which does not allow the container to sit flat on a surface. Instead, the ridge tends to form a fulcrum that renders the carton unstable. Such bottom structures are also subject to bulging which renders them relatively unstable when seated. The bottom seal of such a carton is also subject to wear since it is in direct contact with the surface on which the carton is seated. Additionally, depending on the container contents, the bottom structure may require mechanical sealing strength characteristics beyond those offered by the standard four panel structure.

Another bottom construction is shown in U.S. Pat. No. 5,152,736, issued Oct. 6, 1992, to Owen et al. In that construction, the fin flaps of the bottom structure are cut diagonally and engage bottom flaps at diagonal score lines. During the filling and sealing process, the resulting fin is gripped by specialized sealing jaws and forced upward so that the fin does not interfere with seating of the carton. The side panels engage the bottom structure at straight score lines that define straight creases. The fin is then sealed, in a separate sealing step, by folding the fin flat and heat sealing it to one of the bottom flaps of the container.

The '736 construction has several disadvantages. For example, all four side panels engage the bottom flaps at straight score lines that define straight creases. A downward force is thus exerted on the bottom structure by all four panels, as well as the container contents, to urge the bottom flaps and bottom fin flaps from their non-interfering position when the carton is seated upright. As a result, the bottom seal may become unduly stressed and/or move toward an interfering position. Compensation for this added stress may be achieved, for example, by increasing the thicknesses of the heat sealing layers of the container to increase the strength of the bottom heat seal. However, this results in added production costs, particularly when large production volumes are contemplated.

The gabled tops of standard gable top cartons are typically formed primarily from four top flaps that engage respective side panels of the carton at respective straight score lines that each define a straight crease. Two of the top flaps each include two converging diagonal score lines. The top flaps each engage a respective top fin flap that is divided from the top flap by a respective score line. These structures are folded to form the familiar gable structure that includes an upright fin. One end of the gabled structure constitutes an opening end that has its fin flaps sealed, for example, with an adhesive resin. The user inserts his/her thumbs into an open space beneath the fin flaps to pry them apart and access the container contents. The other end of the gabled structure is typically designated as the closed end and is not designed to be opened by the user.

The conventional gabled top structure suffers from disadvantages in certain situations. In particular, miniature gable top cartons may be difficult to open since the open region beneath the fin flaps at the opening end may not be large enough to accommodate the user's thumbs. The requirement that the open region accommodate the user's thumbs also places a constraint on the height of the gabled structure, even where the carton itself is of a conventional size (i.e., 1 litre).

Further, the additional folds and creases in a conventional gabled top carton create the disadvantage of excess carton material in certain areas that have numerous folds and angles. This excess material creates difficulties in folding the carton (i.e., "bunching" of material in a corner).

BRIEF SUMMARY OF THE INVENTION

A gable top carton and its corresponding carton blank are disclosed. The carton includes curved side creases that are defined by curved score lines that divide one or more side panels from a top gabled structure and/or a bottom structure.

The carton also includes diagonal creases that are defined by diagonal score lines. The diagonal score lines form an apex at one end and extend to a respective vertical score line that separates one side panel from another. The diagonal score line forms an angle with the vertical score line such that the vertex of the angle is coincident with the vertical score line to facilitate easier folding of the gabled structure.

In accordance with one carton embodiment, the carton includes a gabled structure that engages first, second, third, and fourth side panels. The side panels form a hollow rectangular body. The first and third panels form opposite sides of the hollow rectangular body and the second and fourth side panels form opposite sides of the rectangular body. A bottom section engages the first, second, third, and fourth side panels at an end of the side panels opposite the gabled structure. A first curved score line is provided at the engagement between the second side panel and the bottom section. A second curved score line is provided at the engagement between the fourth side panel and the bottom section, the first and second curved score lines defining curved creases which, in turn, define a concave recess into which the bottom section is disposed. A stable concave bottom structure results.

In accordance with another embodiment, a blank for forming a carton having a generally flattened gabled structure is provided. The blank includes first, second, third, and fourth side panels. The side panels are divided from one another by a plurality of vertical score lines. The blank also includes first, second, third, and fourth flaps respectively adjacent the first, second, third, and fourth side panels. The flaps are also divided from one another by the plurality of vertical score lines. Two non-adjacent flaps each include a pair of diagonal score lines that converge at an apex. Each of the diagonal score lines extends to one of the vertical score lines, thereby forming a vertex of an angle therewith. The vertex is coincident with said score line to facilitate folding. The blank further includes first, second, third, and fourth fin flaps respectively adjacent the first, second, third, and fourth flaps. The fin flaps are also divided from one another by the plurality of vertical score lines. A plurality of score lines dividing the fin flaps from the flaps are also provided. The plurality of score lines include a wide score line extending between the apices of said two non-adjacent flaps. The wide score line is generally wider than other score lines separating the flaps from the fin flaps.

In accordance with another embodiment of a gable top carton, the carton has a top gabled structure having an opening end and a closed end. A plurality of side panels engage the gabled structure, at least one of the side panels engages the gabled structure at the opening end. A first curved score line is provided which defines a curved crease formed at the engagement between the side panel and the gabled structure. A second curved score line is disposed adjacent the first curved score line to define an indent surface between the first and second score lines. A pressure may be applied to the indent surface to deform the surface and enlarge the effective opening area beneath the top fin in the region of the opening end of the top gabled structure. Enlarging the effective opening area provides more room for acceptance of a user's thumbs, or the like, to pry open the top fin and allow user access to the contents of the carton.

In accordance with a still further embodiment, a carton having a generally flattened gable structure is provided. The carton includes first, second, third, and fourth side panels, the first and third side panels being opposite one another and the second and fourth side panels being opposite one another. The first, second, third, and fourth flaps respectively engage the first, second, third, and fourth side panels. Two opposite flaps are each provided with a pair of oppositely directed diagonal score lines that converge at an apex. First, second, third, and fourth fin flaps respectively engage the first, second, third, and fourth flaps. A score line that is generally wider than other score lines dividing the flaps from the fin flaps extends between the apices of the two opposite flaps. A fin extension tab extends from one of the fin flaps. The fin extension tab engages one of the fin flaps at a wide score line to allow the fin extension tab to fold over the fin flaps and contact and seal to an exterior surface of one of the flaps.

Additional bottom structures are contemplated which include further score lines that allow the bottom to fold more easily and that effectively absorb material so that the folded bottom structure is not as wide as a folded bottom structure without the added score lines. This provides, among other things, a more stable and structurally sound recessed bottom structure.

In accordance with yet another embodiment of the present invention, a foldable corner section of a gabled carton is provided. The foldable corner section includes a plurality of side panels including first and second non-adjacent side panels. A plurality of bottom flaps respectively engaging the plurality of side panels is also provided. The second and fourth bottom flaps each include a pair of oppositely directed diagonal score lines that converge at an apex. Also, a plurality of vertical score lines separate the plurality of side panels and bottom flaps from each other. Each of the diagonal score lines extends to a respective vertical score line thereby forming a vertex of an angle therewith. The vertex is coincident with the vertical score line.

In accordance with another embodiment, a carton having first, second, third and fourth side panels divided from one another by a plurality of vertical score lines is provided. The side panels form a hollow rectangular body in which the first and third side panels form opposite sides of the body and the second and fourth side panels also form opposite sides of the hollow rectangular body. The carton also includes a gabled structure having first, second, third and fourth flaps divided from one another by the vertical score lines. The flaps also respectively engage the first, second, third and fourth side panels. The second and fourth flaps each include a pair of oppositely directed diagonal score lines that converge at an apex. The diagonal score lines also extend at another end to a respective vertical score line at an edge of the flap. Thus, the diagonal score line forms a vertex of an angle with the vertical score line. In addition, the vertex is coincident with the vertical score line. The carton also includes a bottom section engaging the first, second, third and fourth side panels at an end of the side panels that is opposite the gabled structure. The bottom section may also be a folded gabled structure.

DETAILED DESCRIPTION OF TITLE INVENTION

Figure 1:
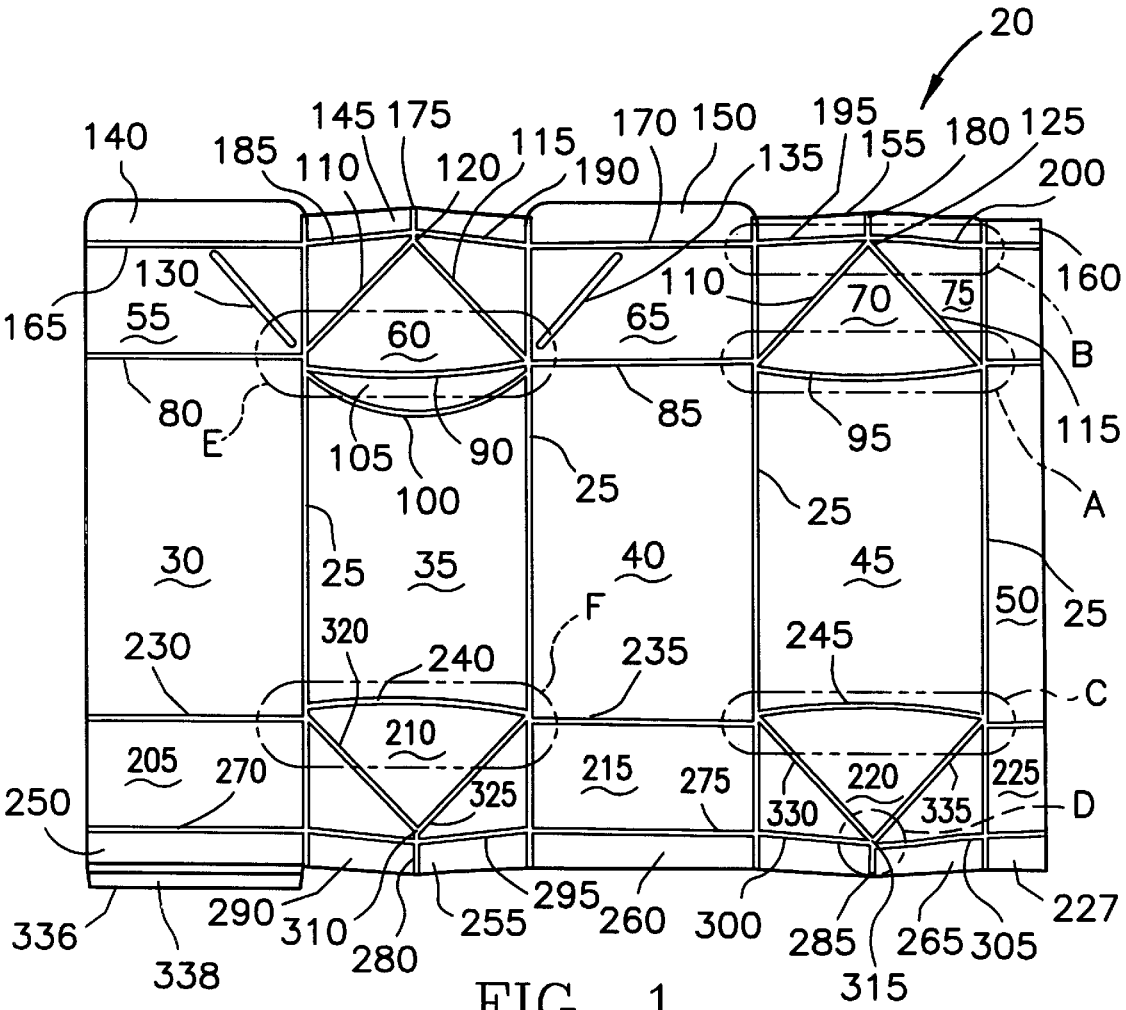
FIG. 1 is a plan view of one embodiment of a carton blank constructed in accordance with the teachings of the present invention.

FIG. 1 illustrates one embodiment of a blank that may be used to form a carton in accordance with the teachings of the present invention. The carton blank 20 has a plurality of panels that are effectively separated from one another by a plurality of score lines. The carton blank 20 is divided by four vertical score lines 25 into first, second, third, fourth and fifth side panels respectively noted as 30, 35, 40, 45, and 50. The fifth side panel 50 has a smaller width than the other side panels and, as will be shown in further detail below, is used to side seal the carton. At the top of the carton blank 20, the side panels 30, 35, 40, 45, and 50 engage respective first, second, third, fourth, and fifth top flaps 55, 60, 65, 70, and 75. The first side panel 30 and the adjacent first top flap 55 are divided from one another by a straight score line 80. Likewise, the third side panel 40 and the adjacent third top flap 65 are divided from one another by a straight score line 85. The second side panel 35 and the adjacent second top flap 60 are divided from one another by a curved score line 90. Likewise, the fourth side panel 45 and the adjacent fourth top flap 70 are divided from one another by a curved score line 95. The second side panel 35 includes a further curved score line 100 adjacent the curved score line 90. As will be explained in further detail below, the curved score lines 90 and 100 of the second side panel 35 define an indent surface 105 therebetween.

Further score lines are provided in the top flaps to assist in defining the creases that will ultimately be made when the blank 20 is folded into a gable top carton. The second and fourth top flaps 60 and 70 each include a pair of diagonal lines 110 and 115 that converge at respective apices 120 and 125. The first and third top flaps 55 and 65 each include a respective diagonal score line 130 and 135 that, as will be apparent from the following discussion, assists in defining the opening end of the carton.

Immediately adjacent the first, second, third, fourth, and fifth top flaps are respective first, second, third, fourth, and fifth top fin flaps 140, 145, 150, 155, and 160. The first and third fin flaps 140 and 150 are generally rectangular with curved corners. The first top panel 55 and the third top panel 65 are divided from their respective top fin flaps 140 and 150 by respective straight score lines 165 and 170. The second and fourth fin flaps 145 and 155 include respective angled top edges. The second and fourth top fin flaps 60 and 70 each include a respective vertical score line 175 and 180. Angled score lines 185, 190, 195, and 200 proceed from the apices 120 and 125 of the second and fourth top flaps and divide the second and fourth top flaps 60 and 70 from the respective second and fourth top fin flaps 145 and 155. The angled score lines 185, 190, 195, and 200 are generally parallel to the angled top edges of the second and fourth top fin flaps 145 and 155.

At the end of the blank 20 opposite the top panel structures, the first, second, third, fourth, and fifth side panels engage respective first, second, third, fourth, and fifth bottom flaps 205, 210, 215, 220 and 225. The first side panel 30 and the adjacent first bottom flap 205 are divided from one another by a straight score line 230. Likewise, the third side panel 40 and the adjacent third bottom flap 215 are divided from one another by a straight score line 235. The second side panel 35 and the adjacent second bottom flap 210 are divided from one another by a curved score line 240. Likewise, the fourth side panel 45 and the adjacent fourth bottom flap 220 are divided from one another by a curved score line 245.

Immediately adjacent the first, second, third, fourth, and fifth bottom flaps are respective first, second, third, fourth, and fifth bottom fin flaps 250, 255, 260 265, and 227. The first and third bottom fin flaps 250 and 260 are generally rectangular and, in the illustrated embodiment, are not as wide as the corresponding first and third top fin flaps 140 and 150. The first bottom flap 205 and the third bottom flap 215 are divided from their respective bottom fin flaps 250 and 260 by respective straight score lines 270 and 275. The second and fourth bottom fin flaps 255 and 265 include respective angled bottom portions. The second and fourth bottom fin flaps 255 and 265 each include a respective vertical score line 280 and 285. Angled score lines 290, 295, 300, and 305 proceed from the apices 310 and 315 of the converging score lines 320, 325, 330, and 335 of the second and fourth bottom flaps 210 and 220. The angled score lines divide the second and fourth bottom flaps 210 and 220 from the respective second and fourth bottom fin flaps 255 and 265. The angled score lines 290, 295, 300, and 305 are generally parallel to the corresponding angled bottom edges of the first and second bottom fin flaps 255 and 265. Score lines 295, 275, and 300 extend between the apices 310 and 315 and are of a greater width than the score lines 270, 290, and 305. For example, the score lines 275, 295, and 300 may be approximately twice as wide as score lines 270, 290 and 305.

A fin extension tab panel 336 extends from the first bottom fin flap 250. The extension tab panel 336 is divided from the first bottom fin flap 250 by a wide score line 338. For example, the wide score line 338 may have a width that is approximately twice as wide as the width of score line 270.

The top and bottom curved creases 90, 95, 240, and 245 may have different radii depending on the size of the carton. For example, a 47 mm×47 mm cross section carton may have top curved creases with radii of 200 mm and bottom curved creases with radii of 200 mm. A 70 mm×70 mm carton may have top curved creases with radii of 350 mm and bottom curved creases with radii of 700 mm. A 95 mm×95 mm carton may have top curved creases with radii of 600 mm and bottom curved creases with radii of 1200 mm. The curved crease 100 may, for example, have a radius of 75 mm for a 70 mm×70 mm carton.

Figure 1A:
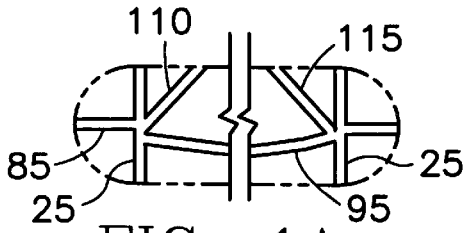
FIGS. 1A–1F are exploded views of various score lines of the carton blank shown in FIG. 1.
Figure 1B:
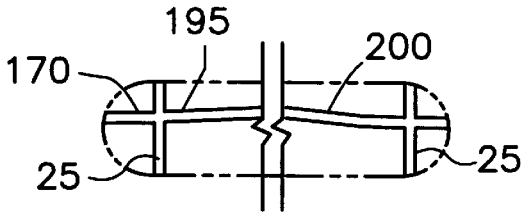
Figure 1C:
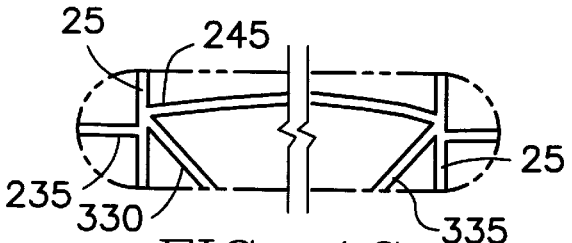
Figure 1D:
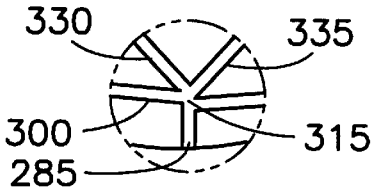

FIGS. 1A, 1B, 1C, 1D, 1E and 1F are enlarged detail sectional views respectively of sections A, B, C, D, E, and F of FIG. 1. The exploded figures illustrate the relative orientation and position of the score lines of each of the respective labelled sections. As illustrated in FIG. 1A, the top curved score lines 90 and 95 are offset below the score line 85. Similarly, as illustrated in FIG. 1C, the bottom curved score lines 240 and 245 are offset above the score line 235.

Figure 1E:
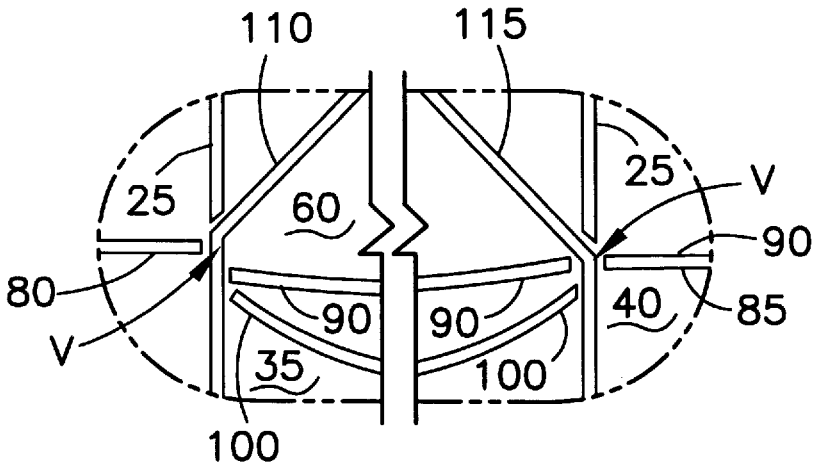

FIG. 1E is an enlarged detail sectional view of Section E of FIG. 1. The region illustrated is near the second top flap 60 of the second side panel 35. The vertical score lines 25 delineate the second side panel 35 from the adjacent first side panel 30 and the adjacent third side panel 40. The relevant section of diagonal score lines 110 and 115 is also illustrated. In this embodiment, a vertex V is formed at the point at which the diagonal score lines 110 and 115 intersect with the vertical score lines 25. The vertex V is thus coincident with the vertical score lines 25, as opposed to being at an offset distance from the vertical score line as in other known containers. When the blank 20 is folded, the diagonal crease of the diagonal score lines 110, 115 meshes into the vertical crease of the vertical score line 25. As a result, when the carton is folded, the ease of folding the corners is improved. As an added advantage, the corner folds do not bunch and therefore crisper, better quality corners result.

Figure 1F:
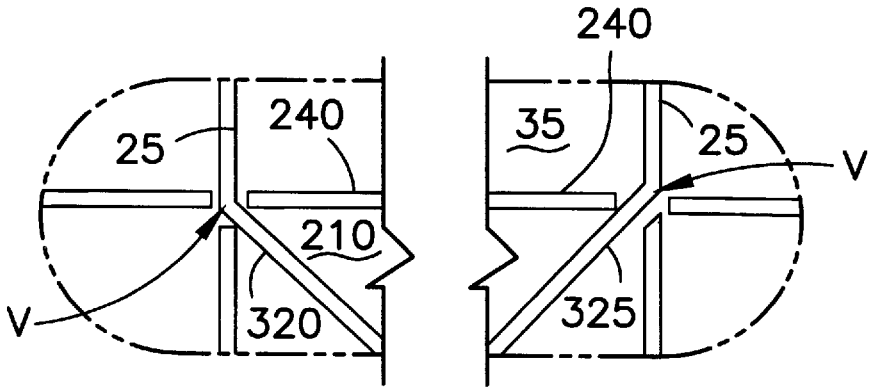

Similarly, FIG. 1F illustrates the second bottom flap 210 of the second side panel 35. In a similar manner, vertex V is formed at the intersection of each diagonal score line 320 and 325 with the vertical score line 25. The vertex V is thus coincident with the score line 25 to provide easier folding. Although the embodiment has been illustrated relative to the second side panel 35, this embodiment is also possible on the fourth side panel 45 between the fourth top flap 70 or the fourth bottom flap 220. The coincident corner crease created by the diagonal score lines coincidentally intersecting the vertical score lines 25 can be used in any or all of the regions having diagonal score lines.

Figure 2:
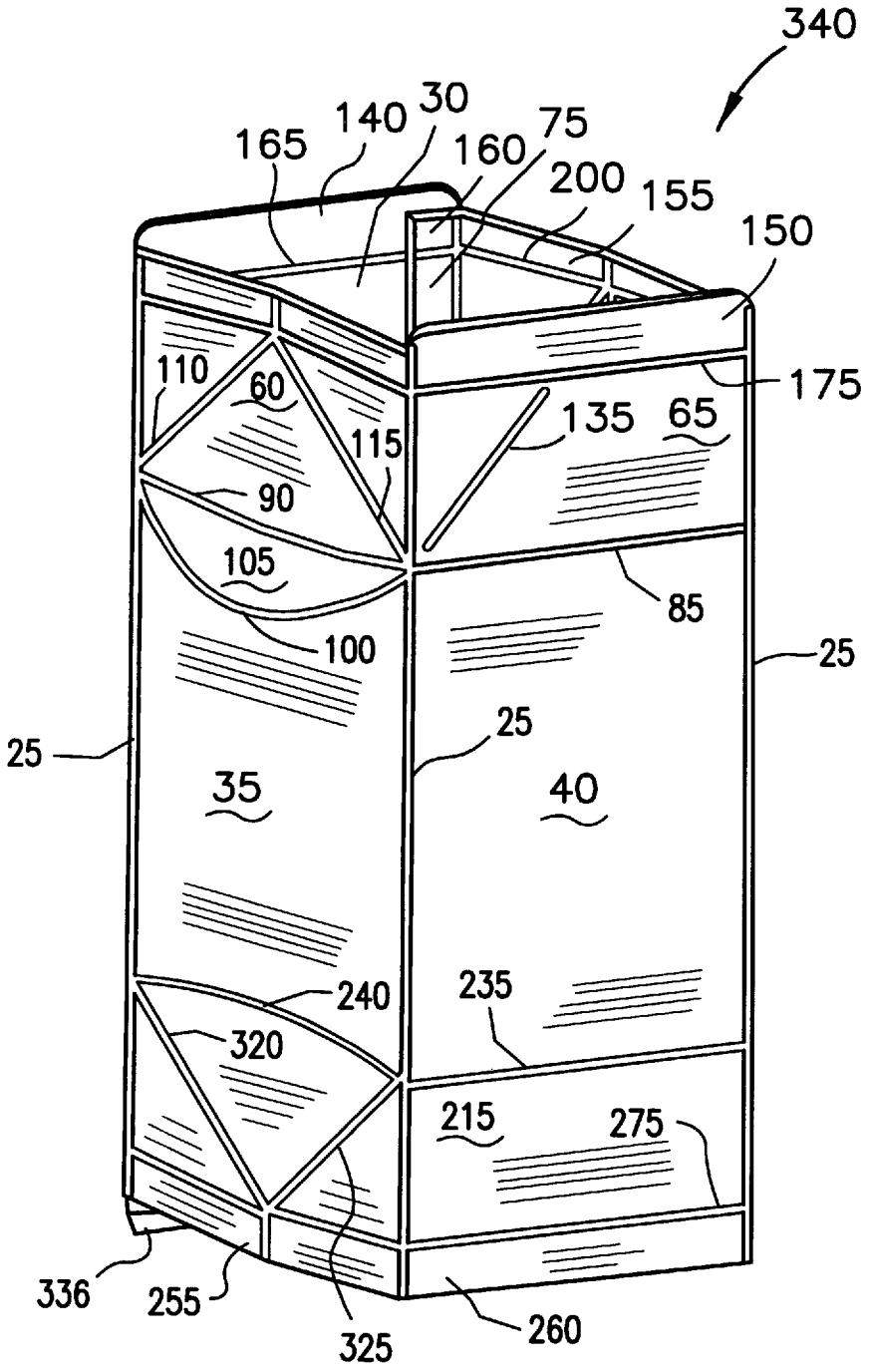
FIG. 2 is a perspective view of the carton blank formed into a hollow rectangular body after sealing the first and fifth side panels to one another.

FIG. 2 illustrates the blank 20 of FIG. 1 at an intermediate folded stage. At this stage, a hollow rectangular structure 340 is formed by folding the carton blank 20 of FIG. 1 along the vertical score lines 25 to form vertical creases. The exterior surfaces of the fifth top fin flap 160, the fifth top flap 75, the fifth side panel 50, the fifth bottom flap 225, and the fifth bottom fin flap 227 are joined to the interior surfaces of the edge of the corresponding first top fin flap 140, the first top flap 55, the first side panel 30, the first bottom flap 205, and the first bottom fin flap 250. This joining may occur, for example, by heat sealing the panels together. Other adhesion methods are also contemplated.

The intermediately folded structure illustrated in FIG. 2 is further foldable to form top and bottom gabled structures. The top fin flaps and top flaps of the structure shown in FIG. 2 are foldable along the illustrated score lines to form a top gabled structure. Similarly, the bottom fin flaps and the bottom flaps of the structure shown in FIG. 2 are foldable along the illustrated score lines to form a bottom gabled structure.

Figure 3:
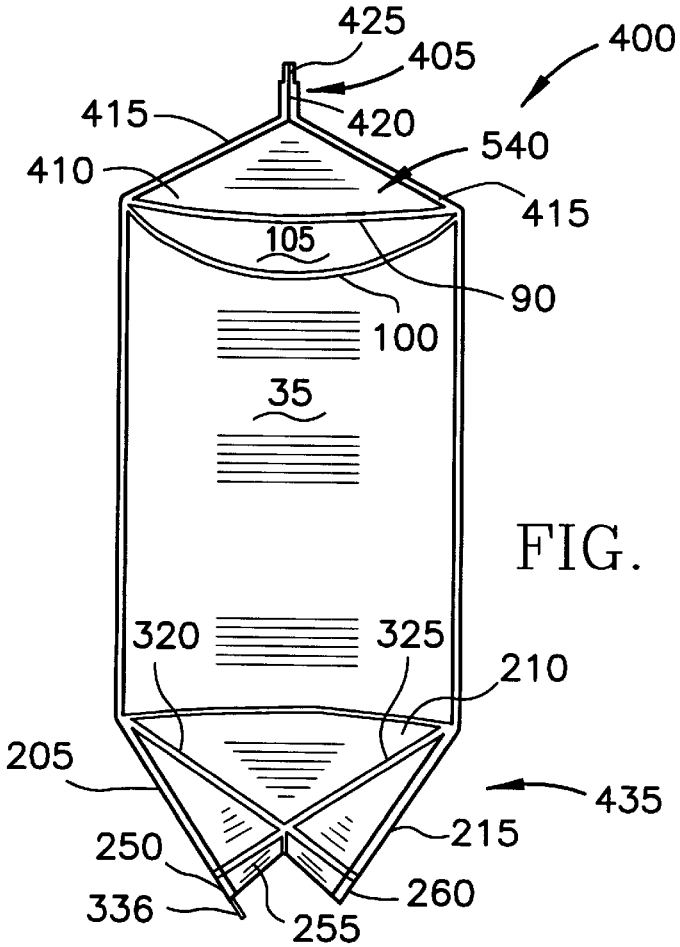
FIG. 3 is a side elevational view of the carton at an intermediate folded stage in which the top gabled section has been sealed.

FIG. 3 illustrates the blank 20 of FIG. 1 at a further intermediate folded stage. In this stage, the top gabled structure 400 has been fully formed. The top gabled structure 400 includes an upstanding fin 405 and underlying and overlying gabled walls 410 and 415. The upstanding fin 405 includes a four layered portion 420 and a two layered portion 425. The four layered portion 420 is comprised of the overlapping sections of all of the top fin flaps while the two layered portion 425 is comprised of the upper portions of the first and third top fin flaps. The fin flaps are joined together, for example, by heat sealing.

The underlying gabled wall 410 of the top gabled structure 400 engages side panel 35 at the curved score line 90 (see also FIG. 1) which, in this folded condition, defines a curved crease. The score line 100 extends across the width of the side panel 35 adjacent the curved crease formed at score line 90. The area between the score line 100 and the curved crease constitutes an indent surface 105.

FIG. 3 also illustrates the bottom gabled section 435 in a partially folded state. In this state, the first and third bottom flaps 205 and 215 and bottom fin flaps 250 and 260 are urged toward one another while the second and fourth bottom flaps 210 and 220 and bottom fin flaps 255 and 265 are likewise urged toward one another. In this process, the first and third bottom flaps are broken along the converging diagonal score lines 320, 325, 330, and 335 (see also FIG. 1) to allow the bottom flaps 210 and 220 to fold toward one another.

Figure 4:
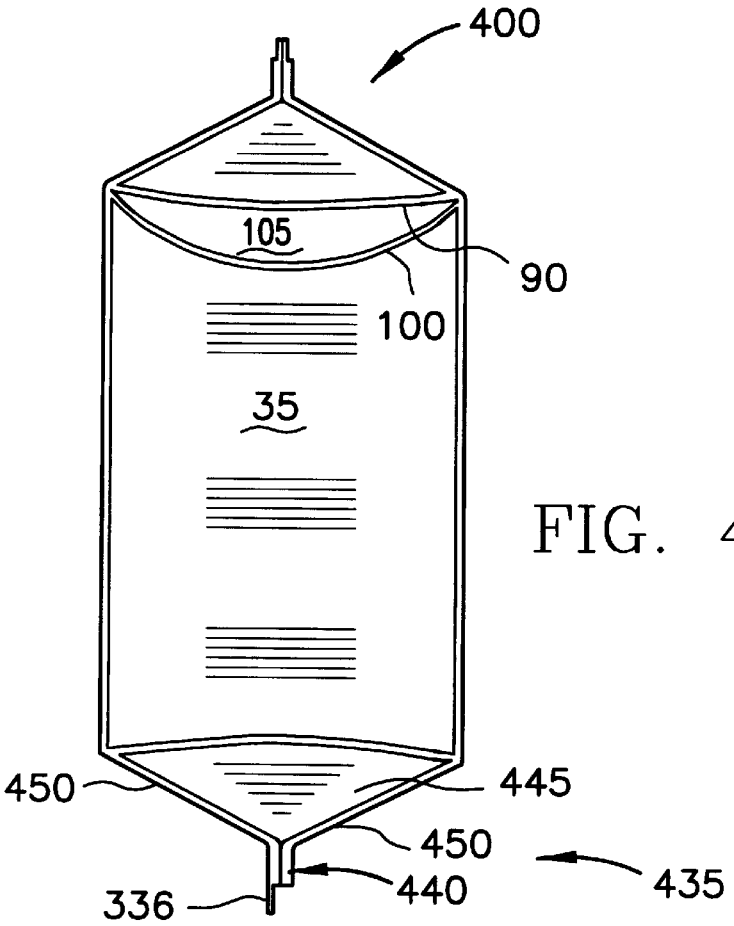
FIGS. 4 and 5 are side elevational views of the carton at a further intermediate folded stage illustrating folded top and bottom gabled structures.
Figure 5:
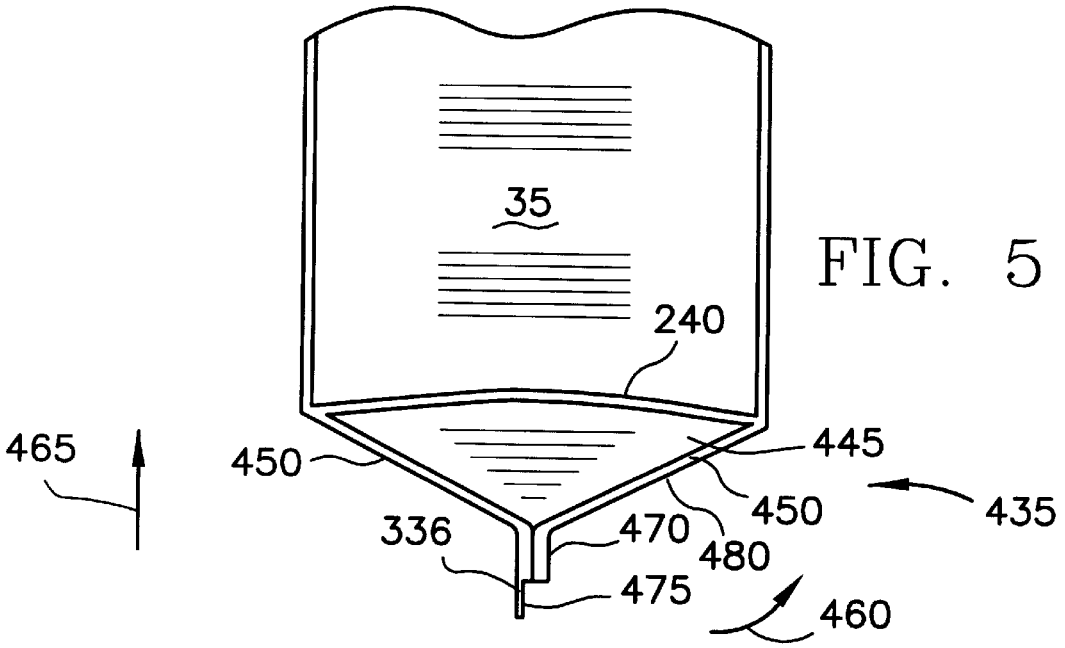
Figure 6:
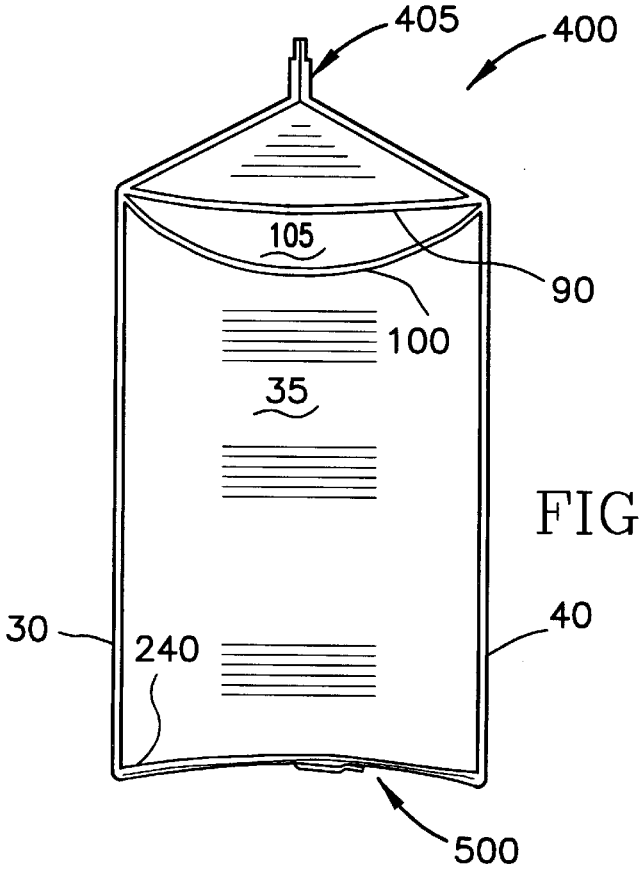
FIGS. 6 and 7 are side elevational views of the fully folded carton.
Figure 7:
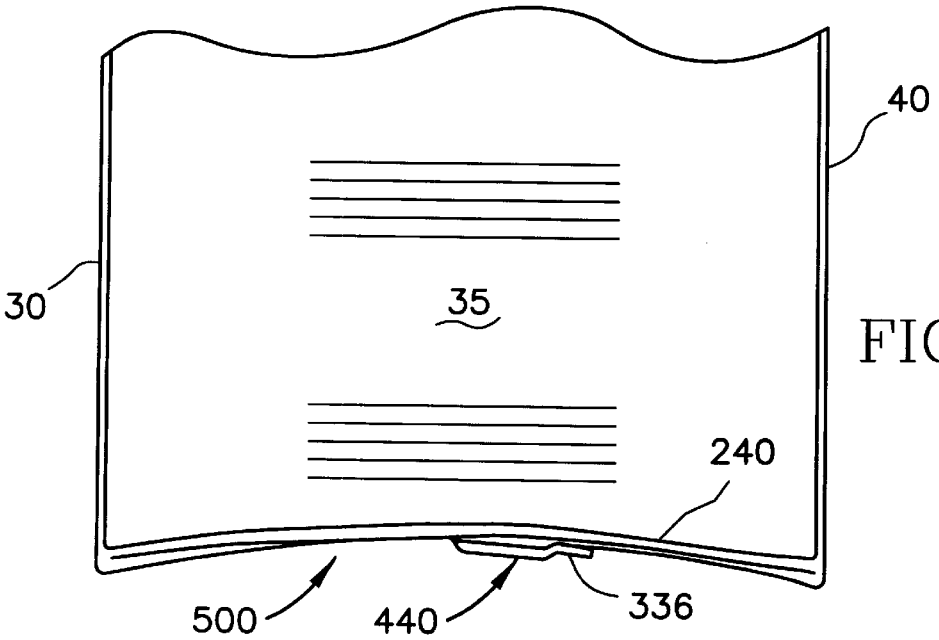

FIGS. 4 and 5 illustrate the blank 20 of FIG. 1 in a still progressively further folded stage. In this stage, the bottom gabled structure 435 is fully formed and includes a bottom fin 440, underlying and overlying gabled walls 445 and 450 (only one underlying wall illustrated), and the fin extension tab 336. The underlying walls 445 of the bottom gabled structure 435 engage the second and fourth side panels 35 and 45 at the curved score lines 240 and 245 and define respective curved creases. The bottom fin 440, unlike the top fin of the present embodiment, includes only a four layered portion that is defined by overlapping sections of all of the bottom fin flaps.

The bottom gabled structure 435 interferes with seating of the formed carton while in the position illustrated in FIGS. 4 and 5. Accordingly, the fin 440 and fin extension tab 336 of the bottom gabled structure 435 are folded over the overlying gabled wall 450 in the direction shown by arrow 460 of FIG. 5. Once the fin 440 and fin extension tab 336 are folded over the overlying gabled wall 450, the bottom gabled structure 435 is urged upward in the direction indicated by arrow 465 of FIG. 5. The surface 470 of the fin 440 and the surface 475 of the fin extension tab 336 are then joined to the exterior surface 480 of the overlying gabled wall 450. Wide score line 338 (FIG. 1) allows the fin extension tab 336 to extend over the edges of the fin 440 and seal to the surface 480 without the creation of an undue amount of space between the fin 440 and fin extension tab 336 that might otherwise compromise the integrity of the bottom seal.

Figure 8:
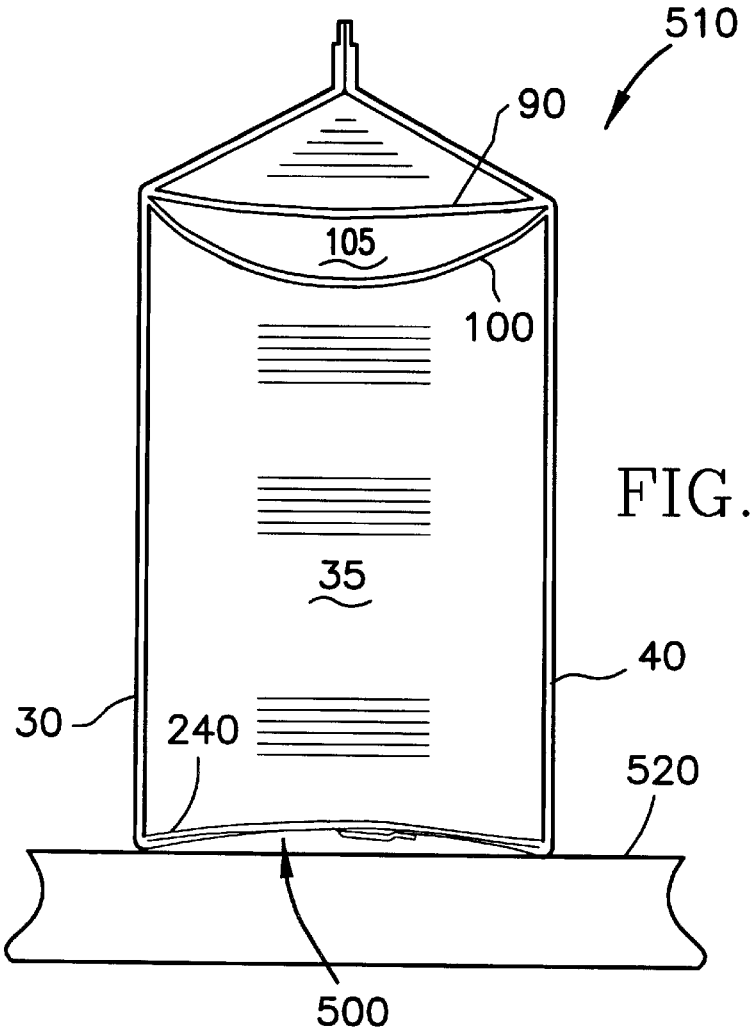
FIG. 8 is a side elevational view of the fully folded carton seated on a flat surface.
Figure 9:
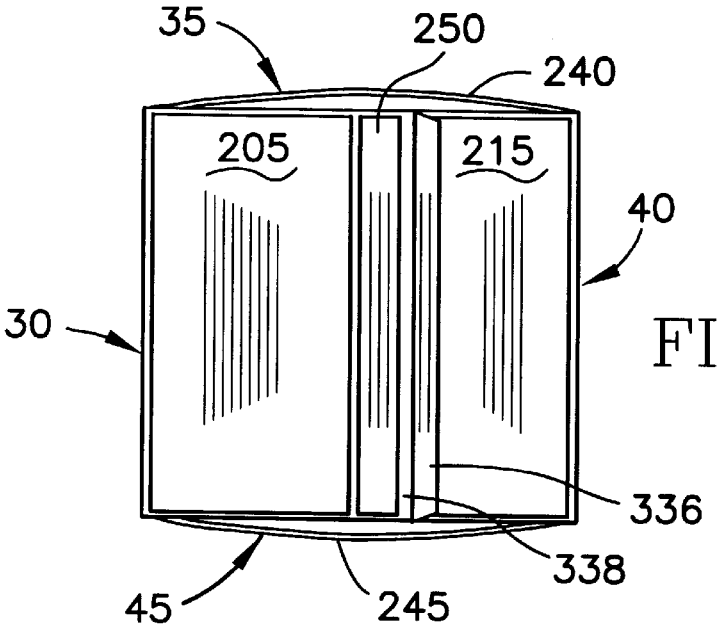
FIG. 9 is a bottom view of the carton showing the gable bottom and extension tab after both have been folded and sealed.

The resulting folded gabled structure is shown in FIGS. 6, 7, 8, and 9. As illustrated, the folded gabled structure 500 is disposed in a concave recess that is defined by the curved score lines 240 and 245 (FIG. 1) along which the curved creases are formed. In this position, as shown in FIG. 8, the folded gabled structure 500 does not interfere with the seating of the formed carton 510 on a flat surface 520. Instead of resting on the bottom gabled structure, the bottom edges of the first and third side panels 30 and 40 support the carton 5 10. This configuration allows the integrity of the bottom seal of the carton to be maintained since the folded gabled structure is not subject to wear from frictional contact with the flat surface 520 on which the carton 510 is seated. Additionally, the magnitude of the natural downward force on the folded gabled structure is not as great as would be exerted in the absence of the curved creases. The construction of the bottom structure illustrating the wide score line 338 is shown in detail in FIG. 9 which is a bottom view of the carton 510.

Figure 10:
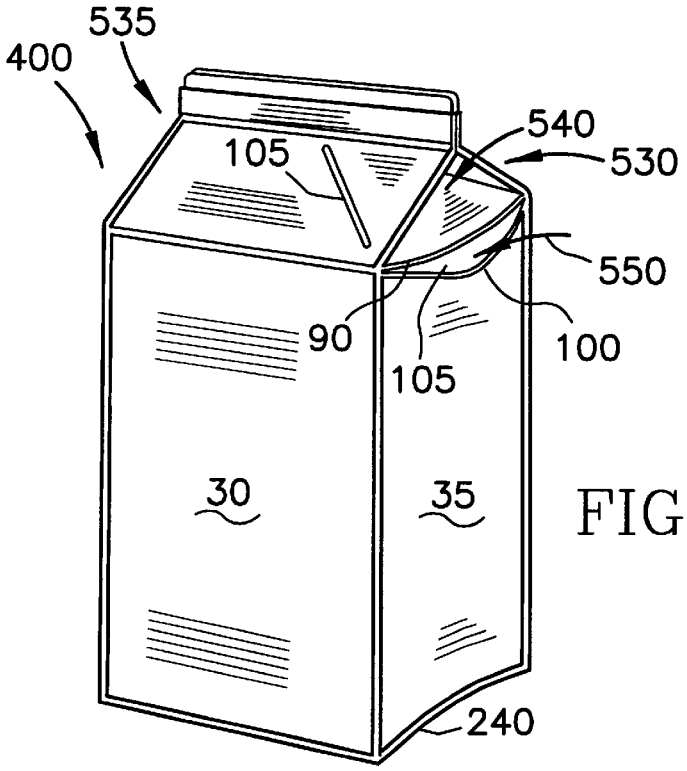
FIG. 10 is a perspective view of the folded and sealed carton.

Referring to FIG. 10, the top gabled structure 400 includes an opening end 530 and a closed end 535. The opening end 530 of the top gabled structure 400 engages the second side panel 35 at the curved score line 90 (FIGS. 1 and 3) that defines a curved crease. An open area 540 is provided to accept, for example, the thumbs of the user to allow the user to pry the layers of the fin 405 apart in the region of the opening end 530.

In many instances, the open area 540 alone may be insufficient to allow the user to pry the carton open. For example, where the top gabled structure has a low profile, the open area 540 may not be large enough to accommodate the thumbs of the user. Similarly, the open area 540 may not be large enough where the carton 340 is relatively small in size.

To overcome many of the problems associated with small opening areas, the carton 340 includes the further curved score line 100 that extends across the width of the second side panel 35. Between the curved score line 90 and curved score line 100 there is the indent surface 105. The indent surface 105 may be urged in the direction shown by arrow 550 to flatten the indent surface area 105 and provide a larger effective opening area 540. With the effective opening area increased, it becomes easier for the user to obtain a position from which the top fin 405 adjacent the opening end 530 may be pried open.

Figure 11:
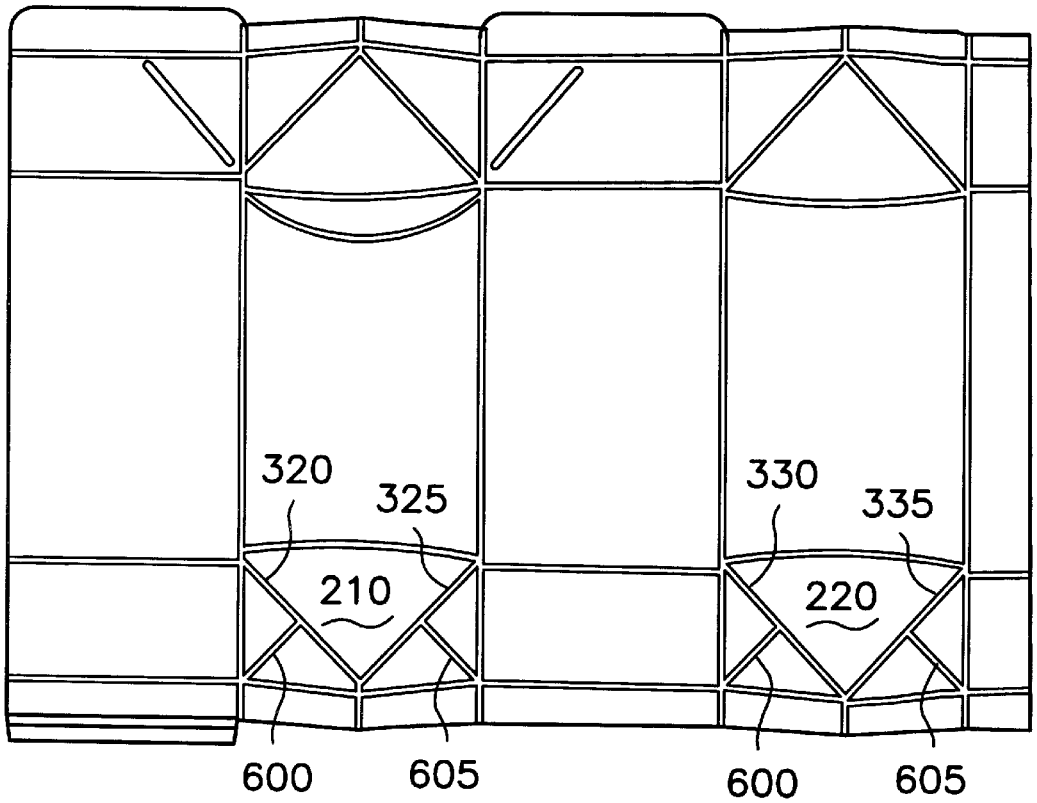
FIGS. 11–14 illustrate carton blanks having various score line configurations for the bottom structure of the carton.

FIGS. 11–14 illustrate carton blanks having added score lines which assist in providing a more structurally sound recessed bottom structure than bottom structures that do not have such added score lines. In the embodiment of FIG. 11, diagonal score lines 600 and 605 extend from the converging score lines 320, 325 to the lower corners of the second bottom flap 210. A similar score line configuration is supplied on the fourth bottom flap 220 as well.

Figure 12:
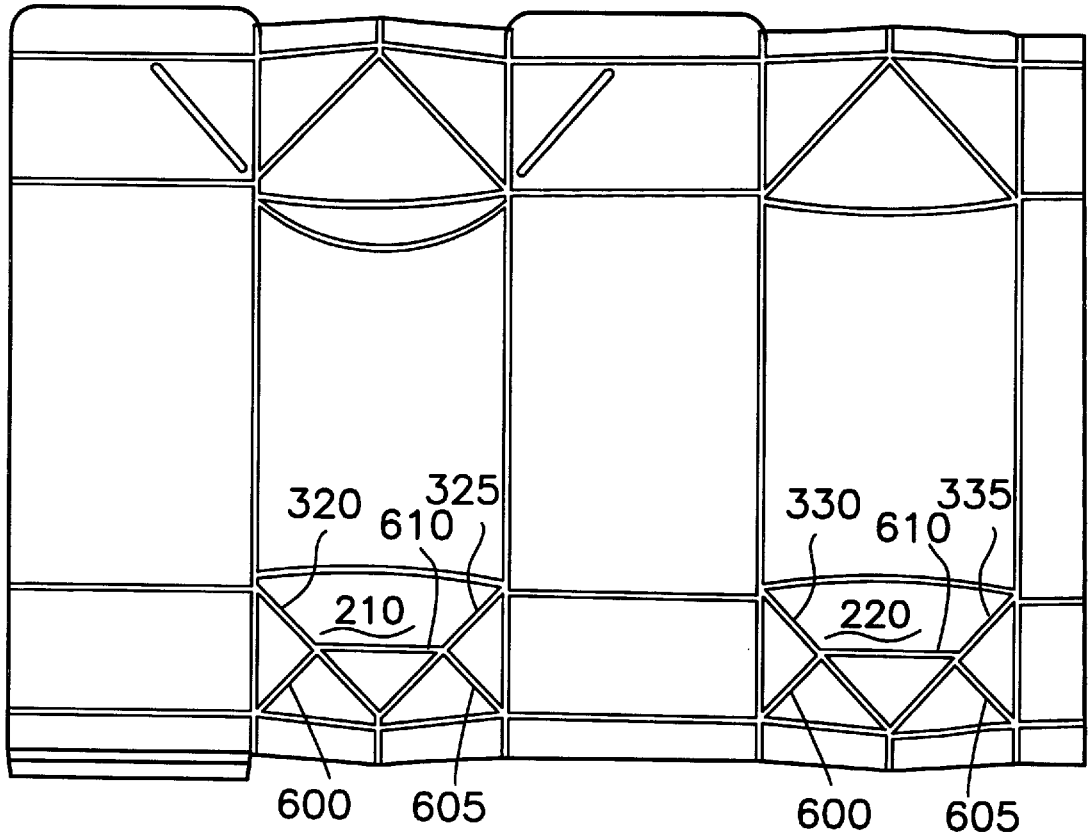

The embodiment of FIG. 12 is similar to the embodiment shown in FIG. 11 except that an added horizontal score line 610 is provided that interconnects the diagonal score lines 600 and 605. A similar score line configuration is supplied on the fourth bottom flap 220 as well.

Figure 13:
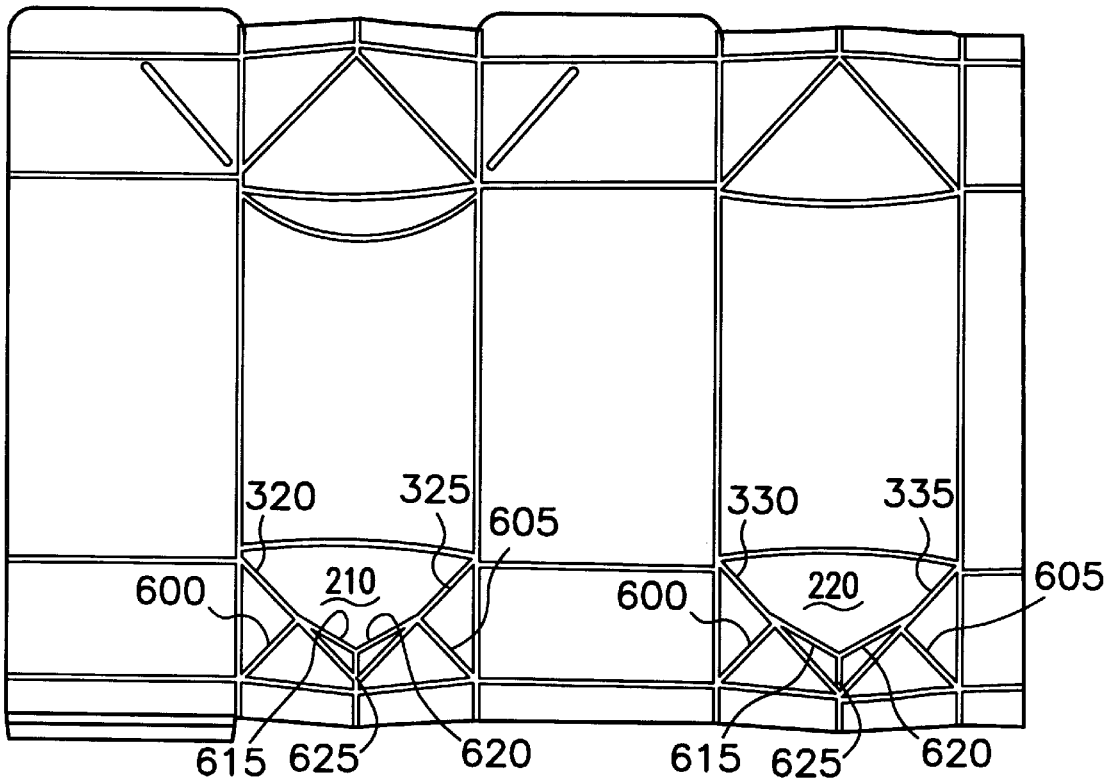

The embodiment of FIG. 13 is similar to the embodiment shown in FIG. 12 except that a generally Y-shaped score line configuration is used in lieu of the horizontal score line 610. The generally Y-shaped score line configuration includes a pair of diagonal arm portions 615 and 620 which intersect a vertical score line 625. The diagonal arm portions 615 and 620 intersect at the mid-portions of diagonal score lines 320, 325 and 330, 335. This score line configuration is provided on both the second and fourth bottom flaps 210 and 220.

Figure 14:
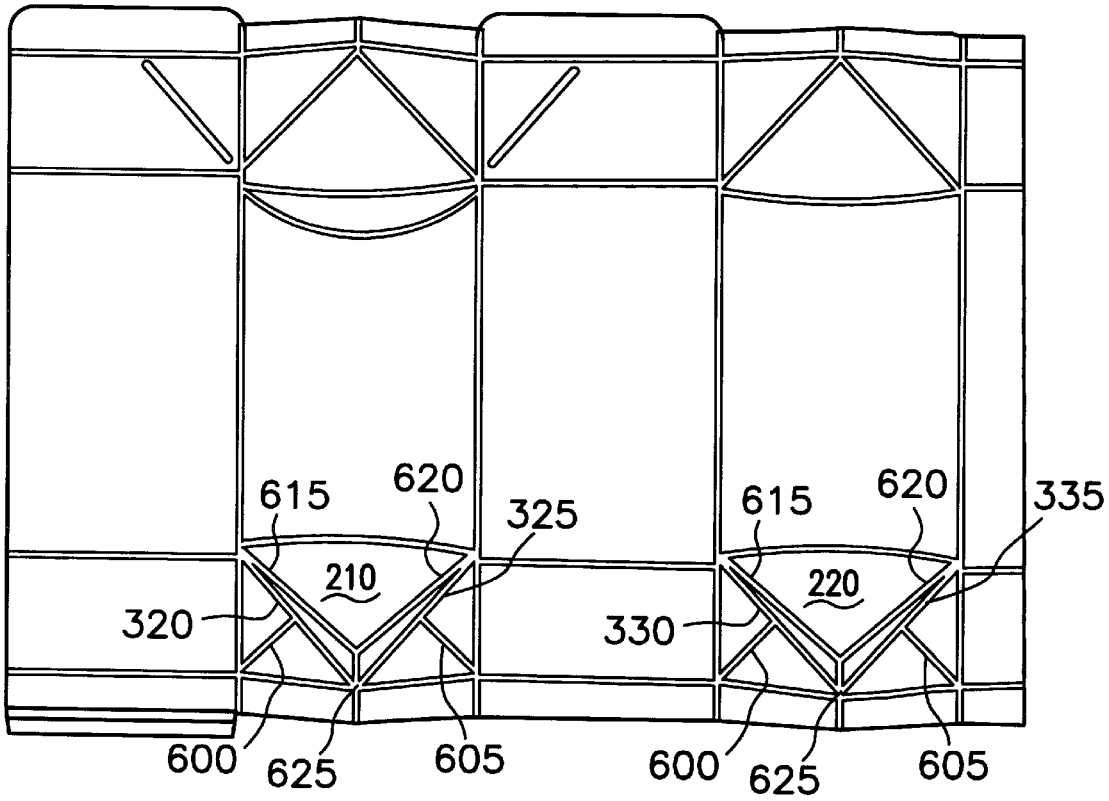

The embodiment of FIG. 14 is similar to the embodiment of FIG. 13 except that the diagonal arm portions 615 and 620 intersect the diagonal score lines 320, 325 and 330, 335 at the upper corners of the bottom flaps 210 and 220.

Figure 15:
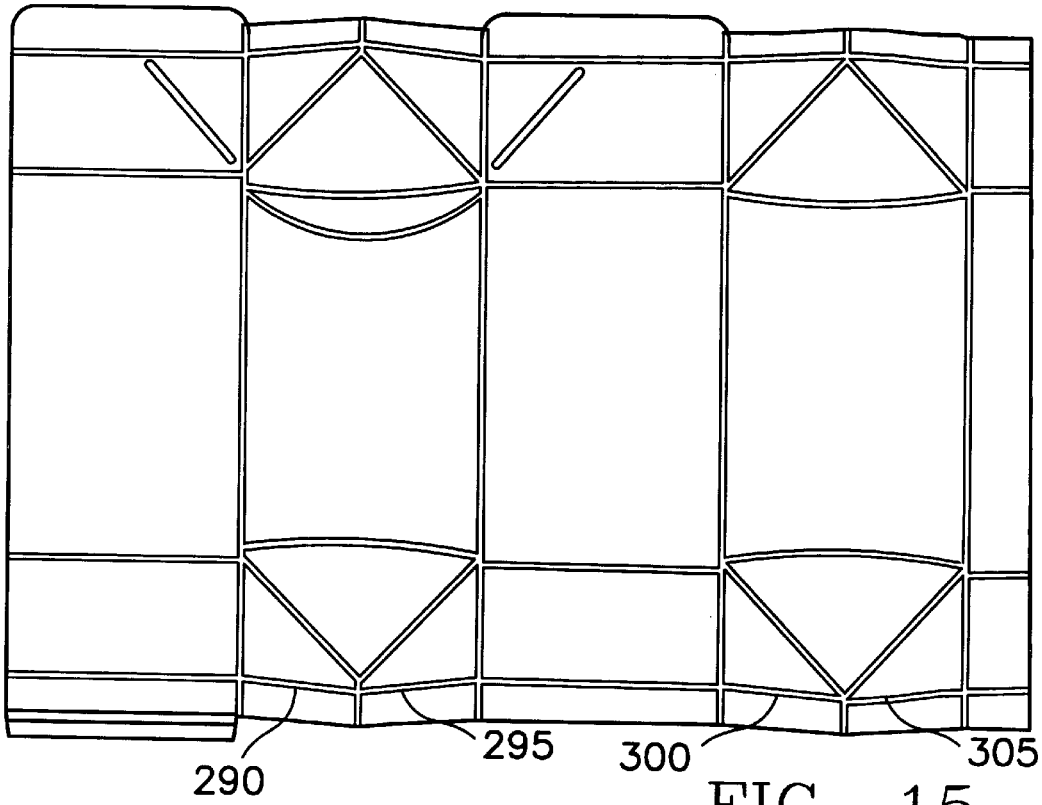
FIG. 15 illustrates a carton blank having an alternative orientation of the wide score lines that proceed across the bottom portions of the bottom flaps.

FIG. 15 illustrates an alternative orientation between the wide score lines 295, 300 and score lines 290, 305. In this alternative orientation, the upper and lower portions of the wide score lines 295, 300 are slightly below the upper and lower portions of the score lines 290, 305.

Figure 16:
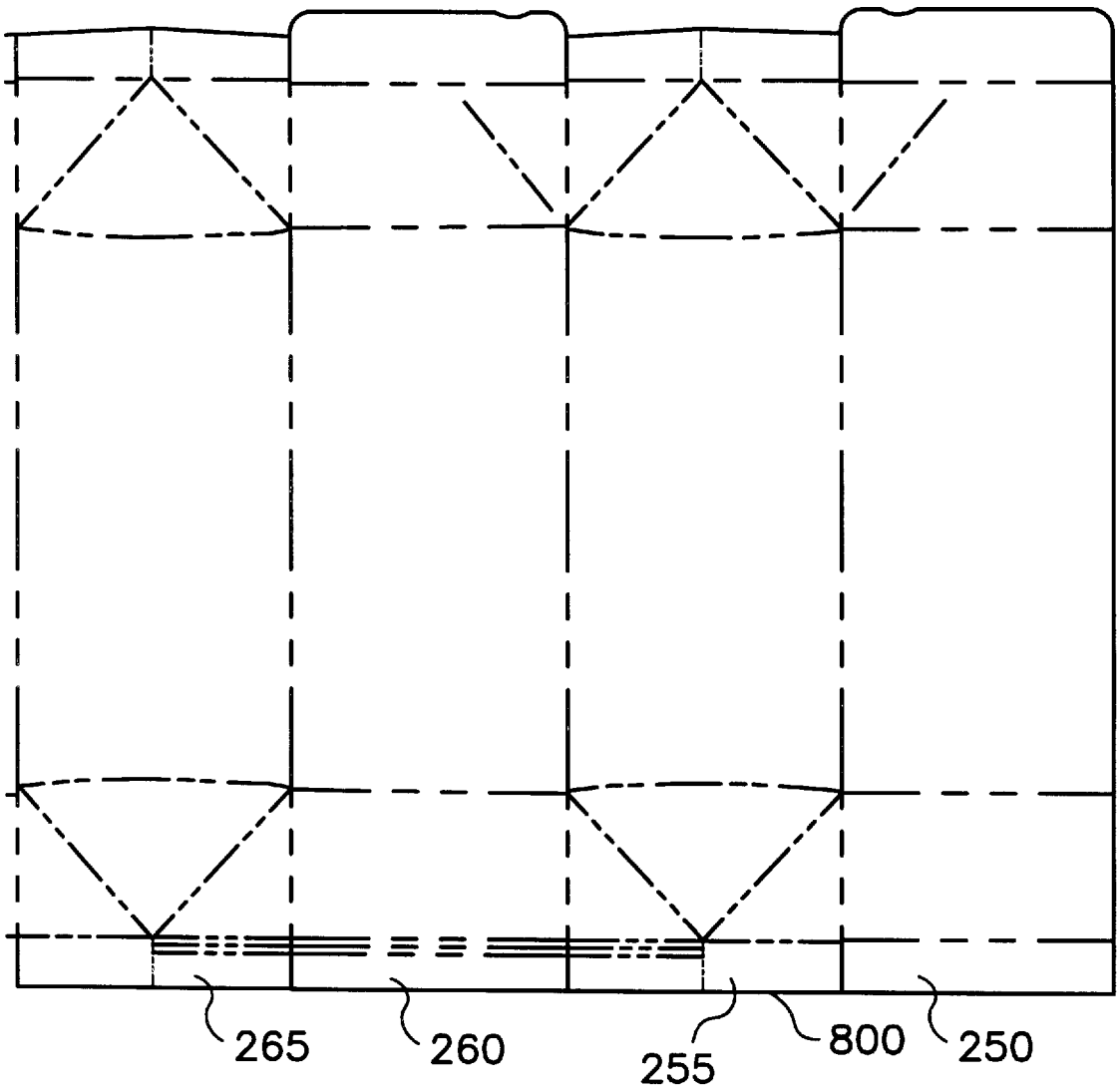
FIG. 16 illustrates a carton blank wherein the bottom of the blank is formed along a straight cut.

FIG. 16 illustrates an alternative embodiment wherein the bottom of fin flaps 250, 255, 260, and 265 proceed at the bottom along a straight edge 800.

Although the present invention has been described with reference to specific embodiments, those of skill in the art will recognize that changes may be made thereto without departing from the scope and spirit of the invention as set forth in the appended claims.

I claim:

1. A blank for fabrication into a gable top carton, the blank comprising:

first, second, third and fourth side panels, the first side panel partitioned from the second side panel by a first vertical score line, the second side panel partitioned from the third side panel by a second vertical score line, the third side panel partitioned from the fourth side panel by a third vertical score line; and first, second, third and fourth top flaps respectively adjacent the first, second, third and fourth side panels, the first top flap partitioned from the first side panel by a first straight score line, the second top flap partitioned from the second side panel by a first curved score line, the third top flap partitioned from the third side panel by a second straight score line, the fourth top flap partitioned from the fourth side panel by a second curved score line, the second top flap having first and second diagonal score lines, the second top flap partitioned from the first top flap by a fifth vertical score line, the second flap partitioned from the third top flap by a sixth vertical score line, the second side panel having a third curved score line below the first curved score line;

wherein the first diagonal score line is coincident with the first vertical score line to form a first vertex, the second diagonal score line is coincident with the second vertical score line to form a second vertex, the fifth vertical score line, the first straight score line, the first curved score line and the third curved score line each having an end terminating about and offset from the first vertex, and the sixth vertical score line, the second straight score line, the first curved score line and the third curved score line each having an end terminating about and offset from the second vertex.

2. The blank according to claim 1 further comprising:

first, second, third and fourth bottom flaps respectively adjacent the first, second, third and fourth side panels, the first bottom flap partitioned from the first side panel by a third straight score line, the second bottom flap partitioned from the second side panel by a fourth curved score line, the third bottom flap partitioned from the third side panel by a fourth straight score line, the fourth bottom flap partitioned from the fourth side panel by a fifth curved score line, the second bottom flap having third and fourth diagonal score lines, the second bottom flap partitioned from the first bottom flap by a seventh vertical score line, the second bottom flap partitioned from the third bottom flap by an eighth vertical score line, wherein the third diagonal score line is coincident with the first vertical score line to form a third vertex, the fourth diagonal score line is coincident with the second vertical score line to form a fourth vertex, the seventh vertical score line, the third straight score line and the fourth curved score line each having an end terminating about and offset from the third vertex, and the eighth vertical score line, the fourth straight score line and the fourth curved score line each having an end terminating about and offset from the fourth vertex.

3. A gable top carton comprising:

first, second, third and fourth side panels, the first side panel partitioned from the second side panel by a first vertical score line, the second side panel partitioned from the third side panel by a second vertical score line, the third side panel partitioned from the fourth side panel by a third vertical score line; and first, second, third and fourth top flaps respectively adjacent the first, second, third and fourth side panels, the first top flap partitioned from the first side panel by a first straight score line, the second top flap partitioned from the second side panel by a first curved score line, the third top flap partitioned from the third side panel by a second straight score line, the fourth top flap partitioned from the fourth side panel by a second curved score line, the second top flap having first and second diagonal score lines, the second top flap partitioned from the first top flap by a fifth vertical score line, the second flap partitioned from the third top flap by a sixth vertical score line, the second side panel having a third curved score line below the first curved score line;

wherein the first diagonal score line is coincident with the first vertical score line to form a first vertex, the second diagonal score line is coincident with the second vertical score line to form a second vertex, the fifth vertical score line, the first straight score line, the first curved score line and the third curved score line each having an end terminating about and offset from the first vertex, and the sixth vertical score line, the second straight score line, the first curved score line and the third curved score line each having an end terminating about and offset from the second vertex.

4. The carton according to claim 3 further comprising:

first, second, third and fourth bottom flaps respectively adjacent the first, second, third and fourth side panels, the first bottom flap partitioned from the first side panel by a third straight score line, the second bottom flap partitioned from the second side panel by a fourth curved score line, the third bottom flap partitioned from the third side panel by a fourth straight score line, the fourth bottom flap partitioned from the fourth side panel by a fifth curved score line, the second bottom flap having third and fourth diagonal score lines, the second bottom flap partitioned from the first bottom flap by a seventh vertical score line, the second bottom flap partitioned from the third bottom flap by an eighth vertical score line, wherein the third diagonal score line is coincident with the first vertical score line to form a third vertex, the fourth diagonal score line is coincident with the second vertical score line to form a fourth vertex, the seventh vertical score line, the third straight score line and the fourth curved score line each having an end terminating about and offset from the third vertex, and the eighth vertical score line, the fourth straight score line and the fourth curved score line each having an end terminating about and offset from the fourth vertex.

* * * * *